US006086954A

United States Patent [19]

Kaufmann et al.

[11] Patent Number: 6,086,954

[45] Date of Patent: Jul. 11, 2000

[54] METHOD AND APPARATUS FOR APPLICATION OF COATING MEDIUM ONTO A TRAVELING MATERIAL WEB HAVING A SPLICE

[75] Inventors: Bernd Kaufmann; Zygmunt Madrzak, both of Heidenheim, Germany

[73] Assignee: Voith Sulzer Papiermaschinen GmbH, Heidenheim, Germany

[21] Appl. No.: 09/014,646

[22] Filed: Jan. 28, 1998

[30] Foreign Application Priority Data

Jan. 29, 1997 [DE] Germany ..... 197 03 211

[51] Int. Cl.[7] ..... B05D 1/28; B05D 5/00; B05C 1/08; B05C 5/00

[52] U.S. Cl. ..... 427/288; 427/428; 118/670; 118/677; 118/678; 118/244; 118/249; 118/261; 118/410

[58] Field of Search ..... 427/428, 288; 118/244, 261, 410, 670, 677, 678, 249

[56] References Cited

U.S. PATENT DOCUMENTS

| | | | |
|---|---|---|---|
| 4,722,297 | 2/1988 | Keable | 118/670 |
| 5,458,913 | 10/1995 | Tsunoda et al. | 427/128 |
| 5,523,122 | 6/1996 | Harada et al. | 427/287 |

FOREIGN PATENT DOCUMENTS

| | | |
|---|---|---|
| 0 720 872 A1 | 7/1996 | European Pat. Off. . |
| 2 400 968 | 3/1979 | France . |
| 200 386 | 11/1907 | Germany . |
| 1131 079 | 6/1962 | Germany . |
| 24 53 884 | 5/1976 | Germany . |
| 43 28 848 | 3/1994 | Germany . |
| 195 00 402 | 7/1996 | Germany . |
| 58-88074 | 5/1983 | Japan . |
| 63-143972 | 6/1988 | Japan . |
| 8-131934 | 5/1996 | Japan . |
| 2 135 912 | 9/1984 | United Kingdom . |
| WO 93/08924 | 5/1993 | WIPO . |

*Primary Examiner*—Katherine A. Bareford
*Attorney, Agent, or Firm*—Taylor & Aust, P.C.

[57] ABSTRACT

A method and an apparatus for direct or indirect one-sided or double-sided application of a liquid or pasty coating medium onto a spliced traveling material web, notably of paper or cardboard, includes at least one applicator applying the coating medium at a predetermined point of coating application onto the material web. At least one coating suspension system briefly suspends the application of the coating medium at the point of coating application or at a point of suspension located, based on the direction of travel of the material web, ahead of the point of coating application. The suspension of the application of coating medium occurs while or before the material web splice passes the point of coating application.

20 Claims, 2 Drawing Sheets

METHOD AND APPARATUS FOR APPLICATION OF COATING MEDIUM ONTO A TRAVELING MATERIAL WEB HAVING A SPLICE

BACKGROUND OF THE INVENTION

1. Field of the Invention

The present invention relates to a method and apparatus for direct or indirect one-sided or double-sided application of a liquid or pasty coating medium onto a spliced traveling material web, notably of paper or cardboard.

2. Description of the Related Art

Methods and apparatuses for direct or indirect one-sided or double-sided application of a liquid or pasty coating medium onto a spliced traveling material web are employed in the framework of so-called coaters in order to provide a material web on one or both sides with one or several layers of a coating medium, for example, color, starch, impregnating solution or the like. Such a web travels at a high speed of up to about 2000 m/min, is formed for instance of paper, cardboard or a textile material, and has a web width up to about 8 meters.

In the so-called direct application, the normally pressurized liquid or pasty coating medium is applied directly onto the surface of a traveling material web by an applicator system or applicator mechanism. During application, the web is supported by a revolving countersurface, for example, an endless belt or a backing roll. In the indirect application of the medium, in contrast, the liquid or pasty coating medium is first applied onto a substrate surface, e.g., the surface of a roll configured as an applicator roll. The coating medium transfers from the applicator roll to the material web in a nip through which the material web passes.

Since a coating system, once set up, usually runs nonstop for both economical and technical reasons, it is necessary to join an expiring material web being coated, which in the uninterrupted operation of the system can be presented only in limited length on rolls or the like, to the material web of a new and unexpired material web roll. Thus is created, so to speak, a material web of "endless length." This joining of two material webs is carried out with the aid of generally known splicing methods and splicing apparatuses. It has been demonstrated, though, that web splices of a traveling material web frequently snap, notably when passing the coating system or applicator, leading to an undesirable interruption of the operation. Such snaps are an appreciable impairment to the productivity and profitability of the coating system. Consequently, minimizing the number of web breaks in splice passes is desirable.

Known from German Patent Document No. DE 195 00 402 A1 is an apparatus for showering a web passing by a showering point with a shower solution, using the so-called curtain principle. According to the principle, the shower solution is poured between two lateral shower holders onto the web, which is carried around a shower roll. The shower solution is poured solely by gravity as a free-falling curtain of solution having several layers. The web travels at a relatively low speed of about 300 meters/min and has a width in German Patent Document No. DE 195 00 402 A1 of about 1400 mm. The apparatus includes devices with which the shower curtain can be blocked when needed, so that it no longer impinges on the passing web. Employed as such a device is a so-called "start-stop plate," which suspends the showering by advancing into the shower curtain such that the solution is collected completely by the start-stop plate and passed into a container. To resume showering, the start-stop plate is retracted from the shower curtain and the solution again impinges onto the web passing the showering point. The apparatus taught in German Patent Document No. DE 195 00 402 A1 and the pertaining showering method according to the principle are usually employed in the manufacture of negative films.

SUMMARY OF THE INVENTION

The present invention improves a categorial method such that unfavorable web break phenomena, particularly of material web splices, will be reduced extensively as compared to the prior art. The present invention also creates a suitable apparatus for the application of this method.

According to the method for direct one-sided or double-sided application of a liquid or pasty coating medium onto a spliced traveling material web, notably of paper or cardboard, by use of at least one applicator applying the coating medium at a predetermined point of application directly onto the material web, the direct application of the coating medium at the point of coating application is briefly suspended as the web splice passes the point of coating application. The spliced material web section passing the applicator does not make contact with the coating medium during that time and, consequently, remains uncoated and dry. The duration of suspension is to be selected in keeping with the application, and will be addressed hereinafter in more detail.

As compared to the prior art, the method according to the invention results in a considerable reduction in the number of breaks of the material web splices passing the applicator, and thus in a reduction of the downtime and scrap associated with failures of material web splices. The operating costs of a coater employing the inventional method are thus lowered while the productivity and profitability are improved appreciably.

According to a configuration feature of the invention, the suspension of the application begins as the material web splice arrives at the point of coating application or immediately before. In the former case, the suspension of the application of the coating medium starts at the beginning of the material web splice approaching the point of coating application, while in the second case the suspension starts before the beginning of the splice.

In a configuration variant of the inventional method, the duration $T_U$ of the suspension of the direct coating medium application conforms to $$T_U \geqq L_S / v_M \tag{1}$$

wherein $L_S$ is the length of the material web splice in the direction of material web travel and $v_M$ is the speed of the traveling material web. From the interpretation of formula (1) in conjunction with the instant in time at which suspension starts, as illustrated above, it follows that the duration of suspension is selected such that the entire spliced material web section and perhaps an area of the material web contained before and after the spliced material web section remains uncoated and dry.

The invention is not limited, of course, to these steps of the method. For certain applications it may be sufficient to select the instant of suspension start and the duration of suspension such that merely a considerable part of a spliced material web section remains uncoated and dry, so as to achieve the desired positive effect of the inventional direct method.

According to this method for indirect one-sided or double-sided application of a liquid or pasty coating medium onto a spliced material web, notably of paper or cardboard, traveling at a speed $v_M$, the indirect application of the coating medium at the point of coating application is briefly suspended. The application is performed by use of at least one applicator applying the coating medium indirectly, by way of a substrate surface intended to receive the coating medium, traveling at a speed $v_T$ and applying it at a previously determined point of coating application on the material web. The coating medium application on the substrate surface is briefly interrupted at a point of suspension located, based on the direction of travel of the coating medium or of the material web, ahead of the point of coating application. To be understood as the traveling direction of the coating medium is the direction in which the coating medium already applied onto the substrate surface, for instance an applicator roll, is carried to the actual point of coating application, where the medium transfers from the substrate surface to the material web. When using the aforementioned applicator roll, for example, the application of the medium onto the applicator roll is thus suspended at a suitable instant and for a specific suitable duration. Thus, the applicator roll remains uncoated for a time and no coating medium can be carried to the point of coating application and transferred to the traveling material web.

Depending on the applicator used, it may be necessary to interrupt, simultaneously with the suspension, the feeding of fresh coating medium to the applicator roll. It may also be necessary to remove coating medium remainders possibly clinging to the roll, so that the spliced material web section passing the point of indirect coating application remains either entirely or at least substantially dry and uncoated. To achieve exactly this effect, the instant of beginning and the duration of the suspension of feeding the coating medium to the applicator roll must be matched very accurately to the momentary position and the respective travel speed of the material web splice approaching the point of indirect coating application. This detail will be addressed more fully yet hereinafter.

This inventional indirect method, too, offers the advantages already illustrated in detail above, in conjunction with the inventional direct application method.

A configuration feature of the inventional indirect method provides for starting the suspension of the coating application at a point of suspension $S_U$ a distance Y3 away from the point of coating application, on the substrate surface traveling at the speed $v_T$. The suspension starts at an instant T3 at which the beginning of the material web splice, approaching the point of coating application at the web speed $v_M$, is located a distance X3 from the point of coating application, where $$Y3/v_T \leqq X3/v_M \quad (2)$$

From the interpretation of formula (2) it follows that the instant of suspending the coating medium application onto the substrate surface is selected such that the substrate surface, approaching the point of indirect coating application simultaneously with the material web and its splice, no longer transfers any further coating medium to the material web and thus to the material web splice past a certain point on the web. That certain point is located before or directly at the beginning of the material web splice approaching the point of coating application or momentarily located directly at the point of coating application.

According to a further embodiment of the inventional indirect method, the duration $T_U$ of suspending the coating medium application on the substrate surface conforms to $$T_U \geqq L_S/v_M \quad (3)$$

wherein $L_S$ is the length of the material web splice in the traveling direction of the material web, and $v_M$ is the speed of the traveling material web. As follows from formula (3) in conjunction with the instant of suspension start defined by the above formula (2), the duration of suspension is selected such that the entire spliced material web section, and perhaps an area of the material web contained before and after the spliced material web section, remains completely or substantially uncoated and dry.

This apparatus for direct or indirect one-sided or double-sided application of a liquid or pasty coating medium onto a spliced traveling material web, notably of paper or cardboard, includes at least one applicator applying the coating medium at a predetermined point of coating application on the material web. At least one coating suspension system briefly suspends the coating medium application at the point of coating application or at a point of suspension while or before the material web splice passes the point of coating application. The point of suspension is located, in relation to the direction of travel of the material web, ahead of the point of coating application.

This apparatus is suited to carry out the inventional method and also offers the advantages already illustrated in detail in conjunction with the two inventional methods.

In a configuration variant of the inventional apparatus, the applicator includes at least one nozzle, or open-jet nozzle, from which the coating medium ejects as an open jet extending through the ambient atmosphere. At least one countersurface opposes the open-jet nozzle and is to be coated with the open jet. The coating suspension system features at least one baffle which for brief suspension of the open jet can be moved, in a direction crossing the open jet, into or through it, or the "coating medium curtain" formed by it. Understood as a countersurface in the purport of the invention is either a substrate surface, e.g., an applicator roll (indirect application) or the material web itself (direct application). The baffle ensures a suspension of the direct or indirect coating application effected by the applicator, without having to interrupt the operation of the applicator itself and thus the ejection of the coating medium from the open-jet nozzle. The baffle can be used in conjunction with both the above inventional direct method and the indirect method. Furthermore, most prior nozzle applicators can be retrofitted easily and without appreciable expense with a coating suspension system.

The baffle can be arranged so as to be able to perform translatory and/or rotatory movements. In this context it is also suitable for the inventional apparatus to include at least one suitable drive for the translatory and/or rotatory movement of the baffle.

An arrangement allowing rotatory movement is especially easy to realize by fixing the baffle on at least one swivel arm hinged to the applicator. The baffle can then be moved, by use of a swivel movement of the swivel arm in a direction crossing the coating medium jet ejecting from the nozzle of the applicator, through the jet, thus suspending the direct or indirect application of the coating medium as desired. The necessary dimensions of the baffle derive, normally making allowance for the above formulas (1) through (3), from the given apparatus and process parameters. Such process parameters include most notably the dimensions of the material web splice, the speed of travel of the material web, the rotational speed of a substrate surface, for example, an applicator roll, and the baffle moving speed to be matched thereto.

Baffles which are substantially flat or concavely curved have proved to be effective and easy to make, but the invention is not exclusively limited to these particular configuration variants. Other suitable shapes can also be used, such as double-concave, convex or wavy designs etc., all of which may have reinforcements or ribbing and the like.

Instead of or in addition to the baffle described above, the coating suspension system may, according to another embodiment of the invention, include at least one device suspending the coating medium feeding and coordinated with the applicator. Such a device makes it possible to render the feeding or ejection of the coating medium ineffective in a suitable manner, thus achieving the desired brief suspension of the direct or indirect application while or before the material web splice passes the point of coating application. The suspension device, e.g., can be an automatically actuated shut-off valve, a slide or the like coordinated with the applicator and equipped with a relevant feed line for the coating medium.

In view of the inventional indirect method, provisions in the framework of another configuration variant of the inventional apparatus call for the applicator to include at least one traveling substrate surface on which the coating medium is applied. Such a substrate surface can be, for example, the periphery of an applicator roll carrying the coating medium to the predetermined point of coating application and there transferring it to the traveling material web. The coating suspension system is equipped with at least one coating medium stripping element which, based on the direction of travel of the substrate surface, follows the applicator and precedes the predetermined point of coating application. The coating medium stripping element is able to make contact with the substrate surface in order to effect a brief suspension of the coating medium application onto the substrate surface. Achievable in this way is a desired brief suspension of the indirect application while or before the material web splice passes the point of coating application. As a coating medium stripping element, e.g., consideration goes to one or several stripping blades, stripping bars, stripping rolls or the like as well as combinations thereof.

Lastly, the inventional apparatus includes as an additional configuration feature at least one control system effecting the exact instant of suspension and/or the respective duration of suspension. The control system may include suitable measuring, regulating and data processing systems.

The inventional method and inventional apparatus can be employed not only in conjunction with the illustrated material web splices, but also in view of any defects contained in the material web, such as holes, local thin spots or similar. The brief suspension of the direct or indirect application occurs substantially analogously to the suspension with a material splice. As parameter $L_S$ governs the calculation of the suspension duration, however, the length of the defect or defective area in the traveling direction of the material web replaces the length of the material web splice in the traveling direction of the material web.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
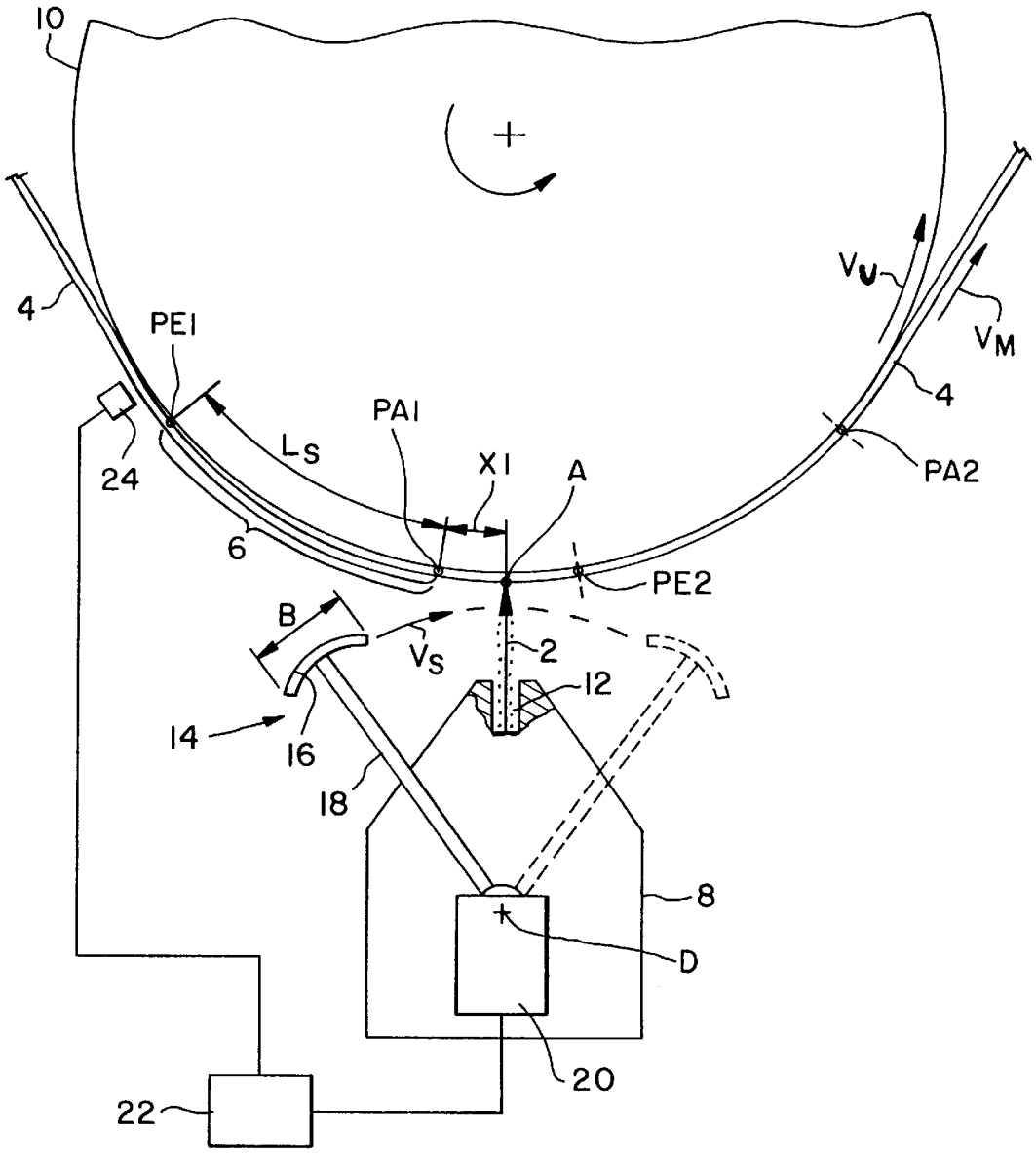
FIG. 1 is a schematic, cross-sectional illustration of a first embodiment of the inventional apparatus in the area of a coating system.

FIG. 1 shows a schematic, greatly simplified cross-sectional illustration of a first embodiment of the inventional apparatus within the realm of a coating system. The apparatus according to FIG. 1 is one for direct one-sided application of a liquid or pasty coating medium 2 onto a traveling material web 4, notably of paper or cardboard, spliced at 6. Presently an open-jet applicator 8, the coating apparatus is arranged opposite a rotating backing roll 10 carrying the traveling fiber material web 4 being coated with coating medium 2. The peripheral speed $V_U$ of rotating backing roll 10 corresponds in this configuration to the web speed $v_M$ of traveling material web 4 ($V_U=v_M$).

As follows from the drawing, open-jet nozzle applicator 8 includes a nozzle 12 from which ejects liquid or pasty coating medium 2 in an open jet, indicated by arrow, extending through the ambient atmosphere. Coating medium 2 is applied at a predetermined coating location referenced A onto traveling material web 4 spliced at 6. The position of material web splice 6 at an assumed instant T1 is defined by the position of the start PA1 and end PE1 of the material web splice 6 and its length $L_S$, based on the direction of travel of material web 4, on the periphery of backing roll 10.

Furthermore, the apparatus is equipped with a coating suspension system 14 which briefly suspends the application of coating medium 2 at location A as material web splice 6 passes the point of coating application A. This will be explained yet in further detail. Coating suspension system 14 includes a concavely curved baffle plate 16 which substantially extends across the entire machine width of the apparatus and is fixed with its side edges on the free end of a swivel arm 18 hinged to a pivot D of applicator system 8. As indicated by arrow in FIG. 1, baffle plate 16 is, for brief suspension of the coating application jet ejecting continuously from the nozzle 12, movable from a first position, illustrated by solid lines, in a direction crossing the open jet and on through it to a second position, indicated by dashed lines. Similarly, it is possible for baffle plate 16 to swivel back from the second to the first position as needed.

Pivot D of swivel arm 18 of baffle plate 16 is coupled to an automatically actuated drive system 20, which allows the swivel motion of swivel arm 18 and baffle plate 16. Drive system 20, in turn, is connected to an automatic controller 22 controlling the exact instant of suspension and/or the relevant duration of suspension. Connected to a measuring system 24 with a position sensor as well as control, switching and data processing systems, controller 22 determines an exact momentary position of material web splice 6 of traveling material web 4 in relation to point of coating application A or another point of reference. Controller 22 also activates drive system 20 in a suitable manner, depending both on the position of splice 6 and other parameters to be allowed for, specifically the usually predetermined dimensions of material web splice 6 and of baffle plate 16 as well as the speed of travel $v_M$ of material web 4.

The following steps are carried out for brief suspension of the direct application of-coating medium 2 at point of coating application A while material web splice 6 passes it.

At the instant T1 at which material web splice 6, approaching the point of coating application A, is located in the momentary position represented by the points PA1 and PE1 a distance X1 from the point of coating application A, drive system 20 is activated by automatic controller 22. Drive system 20 swivels baffle plate 16 in the direction of the point of coating application A toward the open jet ejecting from nozzle 12. The swiveling speed $V_S$ of baffle plate 16 is adapted to speed of travel $v_M$ of material web 4 such that the edge of baffle plate 16 enters the open jet and interrupts it shortly before the start PA1 of spliced material web section 6 arrives at the actual point of coating application A. From this instant forward no further coating medium 2 proceeds onto the following material web section which contains web splice 6. The duration $T_U$ of the open jet interruption in the concrete case computes simply ($T_U$=B/$V_S$) from width B of baffle plate 16 in the direction of travel of material web 4 and from swiveling speed $V_S$ of baffle plate 16. Duration $T_U$ is selected here as $$T_U > L_S/v_M \quad \text{(A)}$$

As swiveling baffle plate 16 departs at an instant T2 again from the open jet and coating medium 2 proceeds again onto traveling material web 4, the entire material web splice 6 has passed point of coating application A completely and is located in an advanced position represented by the points PA2 and PE2. Spliced material web section 6, along with an additional area of the material web 4 before and after, remains uncoated and dry.

Figure 2:
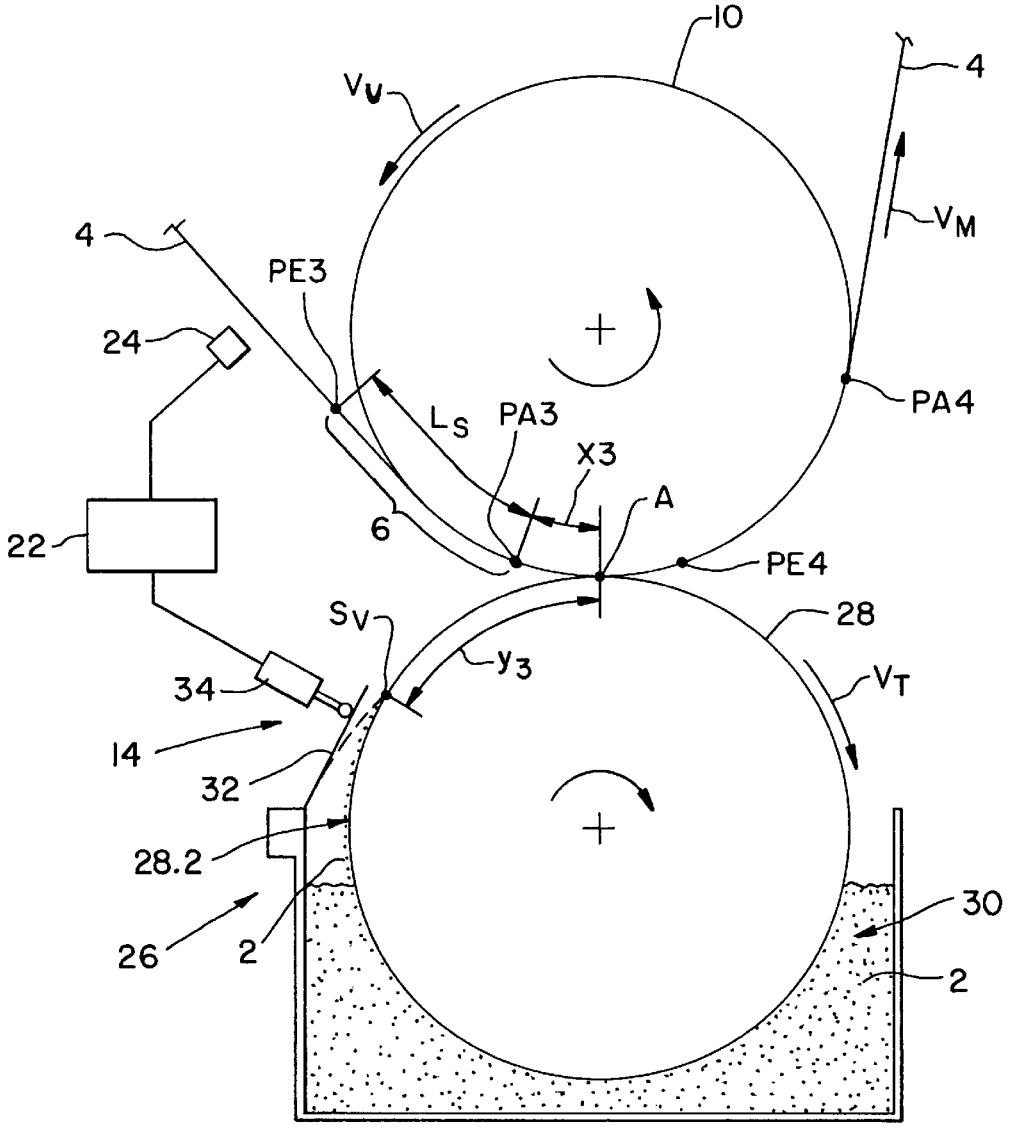
FIG. 2 is a schematic, cross-sectional illustration of a second embodiment of the inventional apparatus in the area of a coating system.

FIG. 2 shows a schematic, greatly simplified cross-sectional illustration of a second embodiment of the inventional apparatus within the realm of a coating system. The apparatus according to FIG. 2 is configured as one for indirect one-sided application of a liquid or pasty-coating medium 2 onto a traveling material web 4, notably of paper or cardboard, spliced at 6. The coating system is in this case a scoop applicator 26 (so-called roll applicator) wherein material web 4, carried by a rotating backing roll 10, passes at a speed of travel $v_M$ through a nip formed by backing roll 10 and a rotating applicator roll 28. In this configuration, the speed of travel $v_M$ of material web 4 matches the peripheral speed $V_U$ of backing roll 10. Rotating at a peripheral speed $V_T$ (where presently $V_T \ll v_M$), applicator roll 28 dips partly into a coating medium bath 30, picks up the liquid or pasty coating medium 2 being applied, with its periphery 28.2 serving as substrate, and carries it to the nip. At the nip, coating medium 2 transfers to material web 4 at point of coating application A. The position of material web splice 6 approaching point of coating application A at an assumed instant T3 is for purposes of the following explanations defined again by the position of the start PA3 and end PE3 of material web splice 6, its length $L_S$ being based on the direction of travel of material web 4, and by the distance X3 from point of coating application A.

This apparatus is also equipped with a coating suspension system 14 including a coating medium stripping element 32 in the form of a doctor blade, arranged on applicator 26. Hereinafter termed stripping blade 32, the coating application stripping element extends substantially across the entire machine width of the apparatus. As follows from FIG. 2, stripping blade 32 is arranged at a position which, based on the direction of rotation of applicator roll 28 indicated by arrow in the drawing, follows an area 30 of the coating system, namely coating medium bath 30, from which the coating medium 2 to be transferred to material web 4 proceeds onto periphery 28.2 of applicator roll 28. Stripping blade 32 is arranged at a position which precedes point of coating application A in the nip.

For brief suspension of the coating medium application on the peripheral surface of applicator roll 28 that serves as substrate surface 28.2, stripping blade 32 is adapted for making contact with substrate surface 28.2. More exactly, the free edge of stripping blade 32 coordinated with applicator roll 28 can be pressed onto substrate surface 28.2 of applicator roll 28 with the aid of a loading system 34 acting on stripping blade 32. Loading system 34 connects, similar to the drive system of the embodiment of FIG. 1, to a corresponding control system 22, 24. At the point of contact $S_U$, stripping blade 32 strips from substrate surface 28.2 the coating medium 2 which previously proceeded from coating medium bath 30 to applicator roll 28. The further transport of coating medium 2 is suspended at point $S_U$ away from point of coating application A, measured on periphery 28.2 as a stretch Y3. Since the coating medium portion on applicator roll 28 which had passed point of suspension $S_U$ before stripping blade 32 contacted surface 28.2 has now passed the nip, no further coating medium 2 can thus transfer at point of coating application A onto traveling material web 4.

In order to keep material web splice 6 of web 4 approaching the point of coating application A uncoated and dry while passing point of coating application A, similar to the embodiment according to FIG. 1, the indirect application of coating medium 2 at point of coating application A is suspended briefly by pressing stripping blade 32 in the previously explained manner, with the aid of loading system 34, briefly onto substrate surface 28.2 of applicator roll 28 at the point of suspension $S_U$ located before point of coating application A. Thus, as previously mentioned, the further carriage of coating medium 2 toward point of coating application A is suspended, and at that, still before material web splice 6 arrives at point of coating application A or passes it. Hence, the instant in time at which to start suspension at point $S_U$ is to be selected with respect to X3, which reduces with time, such that $$Y3/v_T \leqq X3/v_M \quad \text{(B)}$$

The duration $T_U$ during which stripping blade 32 is in contact with substrate surface 28.2, i.e., with the periphery of applicator roll 28, and interrupts the further transport of coating medium 2 to point of coating application A, and thus a transfer of coating medium 2 onto material web 4 at point of coating application A, is thus $$T_U \geqq L_S/v_M \quad \text{(C)}$$

wherein, as already mentioned, $L_S$ is the length of material web splice 6 in the direction of travel of the material web while $v_M$ is the speed of travel of material web 4.

As stripping blade 32 separates again from substrate surface 28.2 of applicator roll 28, coating medium 2 is carried again, on substrate surface 28.2, to point of coating application A and transfers there to traveling material web 4. From the above two formulas (B) and (C) it follows that both the entire material web splice 6, which now has completely passed point of coating application A and is at an instant T4 contained in an advanced position represented by the points PA4 and PE4, and a small area of material web 4 contained before and behind spliced material web section 6, have remained uncoated and dry.

The invention is not limited to the above embodiments, which merely serve the general explanation of the basic idea of the invention. Instead, the inventional method and inventional apparatus may within the scope of protection also assume embodiments other than described above.

Specifically, the apparatus may posses features that represent a combination of the relevant individual features. It is possible to use applicators other than described above, for example, chamber applicators, so-called "speed sizers" (where $V_U=V_M=V_T$) etc. The applicators may be preceded and/or followed by further operating units, such as smoothing or doctor systems etc. It is possible, both in the direct and indirect inventional method and both during the direct or indirect application, that the backing roll or applicator roll continues its rotation not only over part of its periphery, but also for a multiple of its circumference. That is, the roll performs several rotations. This depends on the selected applicator configuration and dimension, and on the distance from the point of coating application A to the end of the material web splice approaching-the point of coating application A.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for one of direct one-sided and direct double-sided application of a coating medium onto a traveling fiber material web having a splice, said method comprising the steps of:

applying the coating medium directly onto the material web at a predetermined point of coating application using an open-jet nozzle applicator to jet the coating medium through ambient atmosphere onto the material web; and suspending said applying step as the material web splice passes said point of coating application.

2. The method of claim 1, wherein said suspending step begins one of as the material web splice arrives at said point of coating application and immediately before the material web splice arrives at said point of coating application.

3. The method of claim 1, wherein said suspending step has a time duration $T_U$, the material web has a speed $v_M$ and a direction of travel, and the material web splice has a length $L_S$ in the direction of travel of the material web such that:

$$T_U \geqq L_S/v_M.$$

4. A method for one of indirect one-sided and indirect two-sided application of a coating medium having a first travel direction onto a traveling fiber material web having a splice, a web speed $v_M$ and a second travel direction, said method comprising the steps of:

coating at least one substrate surface with the coating medium, said at least one substrate surface having a substrate speed $V_T$;

indirectly applying the coating medium onto the material web via said at least one substrate surface at a predetermined point of coating application; and suspending said applying step by suspending said coating step using a coating medium stripping element, said stripping element being configured to directly remove the coating medium from said at least one substrate surface and thereby suspend said applying step, said coating step being suspended at a point of suspension before the material web splice passes said point of coating application, said point of suspension being disposed before said point of coating application relative to one of the first travel direction of the coating medium and the second travel direction of the material web.

5. The method of claim 4, wherein said point of suspension is disposed on said at least one substrate surface a first distance Y3 from said point of coating application, said suspending step beginning when the material web splice is a second distance X3 from said point of coating application such that:

$$Y3/v_T \leqq X3/v_M.$$

6. The method of claim 4, wherein the material web splice has a length $L_S$ in the second travel direction of the material web and said supending step has a time duration $T_U$ such that:

$$T_U \geqq L_S/v_M.$$

7. The method of claim 4, wherein said at least one substrate surface is configured for being fixedly disposed relative to said material web.

8. A method for one of direct one-sided and direct double-sided application of a coating medium onto a traveling fiber material web having a splice, said method comprising the steps of:

applying the coating medium directly onto the material web at a predetermined point of coating application using an applicator; and suspending said applying step as the material web splice passes said point of coating application, wherein said applicator remains fixedly disposed relative to the web throughout the steps of applying and suspending.

9. A method for one of direct one-sided and direct double-sided application of a coating medium onto a traveling fiber material web having a splice, said method comprising the steps of:

applying the coating medium directly onto the material web at a predetermined point of coating application using an open-jet nozzle applicator to jet the coating medium through ambient atmosphere onto the material web; and suspending said applying step as the material web splice passes said point of coating application, said suspending step comprising the use of at least one baffle configured for interrupting said applying step.

10. An apparatus for one of direct one-sided, direct double-sided, indirect one-sided and indirect double-sided application of a coating medium onto a traveling fiber material web having a splice and a first traveling direction, said apparatus comprising:

at least one applicator configured for application of the coating medium onto the material web at a predetermined point of coating application; and at least one coating suspension system configured for suspension of said application of the coating medium at one of said point of coating application and a point of suspension, said coating suspension system comprising at least one baffle in the case of direct one-sided and direct double-sided application, said coating suspension system comprising at least one coating medium stripping element in the case of indirect one-sided and indirect double-sided application, said stripping element being configured to directly remove the coating medium from said at least one substrate surface and thereby suspend said applying step, said suspension occurring one of while and before the material web splice passes said point of coating application, said point of suspension being disposed before said point of coating application relative to the first traveling direction of the web.

11. The apparatus of claim 10, wherein said at least one coating suspension system includes at least one coating medium feed suspension system coordinated with said at least one applicator.

12. The apparatus of claim 10, further comprising at least one control system configured for controlling at least one of an instant of suspension and a time duration of suspension.

13. The apparatus of claim 10, wherein said at least one applicator is configured for being fixedly disposed relative to said material web.

14. An apparatus for one of direct one-sided, direct double-sided, indirect one-sided and indirect double-sided application of a coating medium onto a traveling fiber material web having a splice and a first traveling direction, said apparatus comprising:

at least one applicator configured for application of the coating medium onto the material web at a predetermined point of coating application, said at least one applicator comprising at least one open-jet nozzle opposing the web, said at least one open-jet nozzle being configured for ejecting the coating medium as an open jet extending through an ambient atmosphere onto the web; and at least one coating suspension system configured for suspension of said application of the coating medium at one of said point of coating application and a point of suspension, said at least one coating suspension system including at least one baffle configured for interrupting said open jet by moving in a path crossing said open jet, said suspension occurring one of while and before the material web splice passes said point of coating application, said point of suspension being disposed before said point of coating application relative to the first traveling direction of the web.

15. The apparatus of claim 14, wherein said at least one baffle is configured for performing at least one of translatory and rotatory movements.

16. The apparatus of claim 15, wherein said at least one coating suspension system includes at least one swivel arm pivotally attached to said at least one applicator, said at least one baffle being fixed on said at least one swivel arm.

17. The apparatus of claim 15, wherein said at least one coating suspension system includes at least one drive system configured for at least one of translatory and rotatory movement of said at least one baffle.

18. The apparatus of claim 14, wherein said at least one baffle is substantially one of flat and concave.

19. An apparatus for at least one of indirect one-sided and indirect double-sided application of a coating medium onto a traveling fiber material web having a splice and a first traveling direction, said apparatus comprising:

at least one applicator configured for application of the coating medium onto the material web at a predetermined point of coating application said at least one applicator includes at least one traveling substrate surface having a second traveling direction, said at least one traveling substrate surface being configured for being coated with the medium and transferring the coating medium to the material web at said predetermined point of application; and at least one coating suspension system configured for suspension of said application of the coating medium at one of said point of coating application and a point of suspension, said coating suspension system comprising at least one coating medium stripping element disposed after said at least one applicator and before said predetermined point of coating application relative to said second traveling direction of said at least one traveling substrate, said at least one coating medium stripping element being configured for contacting said at least one traveling substrate surface and thereby suspending coating application on said at least one traveling substrate surface with said suspension occurring one of while and before the material web splice passes said point of coating application, said point of suspension being disposed before said point of coating application relative to the first traveling direction of the web.

20. The apparatus of claim 19, wherein said at least one traveling substrate is configured for being fixedly disposed relative to the material web.

* * * * *